US007851067B2

(12) United States Patent
Caliskanoglu et al.

(10) Patent No.: US 7,851,067 B2
(45) Date of Patent: Dec. 14, 2010

(54) TOOL WITH A COATING

(75) Inventors: Devrim Caliskanoglu, Bruck/Mur (AT); Christian Mitterer, Leoben (AT)

(73) Assignee: Boehler Edelstahl GmbH, Kapfenberg (AT)

( * ) Notice: Subject to any disclaimer, the term of this patent is extended or adjusted under 35 U.S.C. 154(b) by 86 days.

(21) Appl. No.: 12/115,746

(22) Filed: May 6, 2008

(65) Prior Publication Data

US 2009/0007992 A1 Jan. 8, 2009

(30) Foreign Application Priority Data

May 8, 2007 (AT) ..... A 707/2007

(51) Int. Cl.
*B32B 9/00* (2006.01)

(52) U.S. Cl. ..... 428/469; 428/457; 428/698; 428/551; 428/562; 428/638

(58) Field of Classification Search ..... 428/469, 428/457, 698, 544, 546, 551, 562, 570, 569, 428/585, 639, 638; 420/107, 108, 111, 123; 148/328, 405, 318, 334, 335, 581, 320
See application file for complete search history.

(56) References Cited

U.S. PATENT DOCUMENTS

| | | | | |
|---|---|---|---|---|
| 3,463,677 | A * | 8/1969 | Nakamura et al. | 148/328 |
| 4,011,108 | A * | 3/1977 | Hellman et al. | 75/246 |
| 4,366,008 | A * | 12/1982 | Takeuchi et al. | 148/219 |
| 5,981,078 | A | 11/1999 | Tabersky et al. | |
| 6,767,627 | B2 * | 7/2004 | Morikawa et al. | 428/336 |
| 6,861,161 | B2 | 3/2005 | Ponemayr et al. | |
| 2002/0061257 | A1 * | 5/2002 | Hamano et al. | 420/38 |
| 2003/0226625 | A1 * | 12/2003 | Kuehmann et al. | 148/621 |
| 2009/0123779 | A1 * | 5/2009 | Endler | 428/697 |

FOREIGN PATENT DOCUMENTS

| | | |
|---|---|---|
| DE | 25 55 679 | 7/1976 |
| DE | 27 57 639 | 6/1979 |
| DE | 195 30 517 | 2/1997 |
| DE | 102005032860 A1 * | 1/2007 |
| EP | 1 052 301 | 11/2000 |
| GB | 1 523 926 | 9/1978 |
| WO | 01/91962 | 12/2001 |

OTHER PUBLICATIONS

PalDey and Deevi, Single layer and multilayer wear resistant coatings of (Ti,Al)N: a review, No Month 2003, Materials Science and Engineering A 342, pp. 58-79.*

Kaindl et al., Structural investigations of aluminum-chromium-nitride hard coatings by Raman micro-spectroscopy, Sep. 2006, Thin Solid Films 515, pp. 2197-2202.*

(Continued)

*Primary Examiner*—Timothy M Speer
(74) *Attorney, Agent, or Firm*—Greenblum & Bernstein, P.L.C.

(57) ABSTRACT

A coated metal article such as, e.g., a tool, which article comprises a body part comprising a substantially carbon-free precipitation-hardened iron-cobalt-molybdenum/tungsten-nitrogen alloy and carries a coating. The coating has been applied by a PVD method and/or a CVD method and comprises a substantially single-phase crystalline, cubic face-centered structure. This abstract is neither intended to define the invention disclosed in this specification nor intended to limit the scope of the invention in any way.

22 Claims, 3 Drawing Sheets

OTHER PUBLICATIONS

Heim and Hochreiter, TiAlN and TiAlCN deposition in an industrial PaCVD-plant, no month 1998, Surface and Coatings Technology, 98, pp. 1553-1556.*

Danninger H. et al., "Heat Treatment and Properties of Precipitation Hardened Carbon-Free PM Tool Steels," Powder Metallurgy Progress, vol. 5, No. 2, pp. 92-103 (2005).

* cited by examiner

TOOL WITH A COATING

CROSS-REFERENCE TO RELATED APPLICATIONS

The present application claims priority under 35 U.S.C. §119 of Austrian Patent Application No. A 707/2007, filed May 8, 2007, the entire disclosure whereof is expressly incorporated by reference herein.

BACKGROUND OF THE INVENTION

1. Field of the Invention

The present invention relates generally to a tool or an article that carries a coating that is applied according to a PVD or a CVD method. The invention preferably relates to a tool for the cutting of metals, in particular austenitic steels, nickel-based alloys and titanium as well as titanium alloys.

2. Discussion of Background Information

Precipitation hardenable iron-cobalt-molybdenum and/or tungsten alloys are known as tool materials. The production of large tools from these so-called high-speed cutting alloys, however, is associated with a number of problems because, on the one hand, there is a high segregation tendency during the solidification of the melt and, on the other hand, a hot working of the material is possible only within narrow limits at high temperatures.

It has already been proposed (WO 01/91962) to form the tool as a composite tool, only small cutting parts of which are made of an iron-cobalt-tungsten alloy, which parts are connected by welding to a carrier part, usually made of an alloyed steel. It is expected that an improvement of the performance of the cutting parts will be achieved through a powder-metallurgical (PM) production.

In order to increase the edge-holding ability of tools, it has been customary to provide at least the working areas of the cutting tools with a hard surface coating. After the production of the tool in its shape and a heat treatment of the same, at least one layer of hard material, usually of carbide and/or nitride as well as carbon nitride and/or oxide, in particular of the elements Ti and/or Al and/or Cr, is applied according to the PVD or CVD process at temperatures between 500° and 680° C., at the most below the tempering temperature of the tool steel alloy, in particular the high-speed steel alloy.

A hard material coating is also known for hard metals and is widely applied for such tools.

In the past the precipitation-hardened Fe—Co—Mo/W alloys mentioned at the outset as cutting part materials produced improved durability of the tools, particularly when Ti-based materials and the like materials were processed. However, the technological further development of coated high-speed steel tools improved their quality and performance such that tools of carbon-free precipitation-hardened (Fe—Co—Mo) cutting parts with the same coating also have approximately the same property profile or the same edge-holding ability in cutting.

It would be advantageous to have available a tool or an article with much improved performance, particularly in the cutting of metals such as titanium.

SUMMARY OF THE INVENTION

The present invention provides a coated metal article such as, e.g., a tool and in particular, a tool that is suitable for cutting metals. The article comprises a body part comprising a substantially carbon-free precipitation-hardened iron-cobalt-molybdenum/tungsten-nitrogen alloy and carries a coating which has been applied by a PVD method and/or a CVD method and comprises a substantially single-phase crystalline, cubic face-centered structure.

In one aspect of the article, the body part may comprise an alloy which comprises, in % by weight:

| | |
|---|---|
| Co | from about 15.0 to about 30.0 |
| Mo | up to about 20.0 |
| W | up to about 25.0 |
| (Mo + W/2) | from about 10.0 to about 22.0 |
| N | from about 0.005 to about 0.12 |

remainder iron (Fe) and production-related impurities.

In this regard, it is to be appreciated that all alloy weight percentages given in the present specification and the appended claims are based on the total weight of the alloy.

In another aspect of the article, the alloy may comprise (e.g., essentially consist of), in % by weight:

| | |
|---|---|
| Co | from about 20.0 to about 30.0 |
| Mo | from about 11.0 to about 19.0 |
| N | from about 0.005 to about 0.12 |
| Si | from about 0.1 to about 0.8 |
| Mn | from about 0.1 to about 0.6 |
| Cr | from about 0.02 to about 0.2 |
| V | from about 0.02 to about 0.2 |
| W | from about 0.01 to about 0.9 |
| Ni | from about 0.01 to about 0.5 |
| Ti | from about 0.001 to about 0.2 |
| (Nb and/or Ta) | from about 0.001 to about 0.1 |
| Al | from 0 to about 0.043 |
| C | from 0 to about 0.09 |
| P | from 0 to not more than about 0.01 |
| S | from 0 to not more than about 0.02 |
| O | from 0 to not more than about 0.032 |

remainder iron (Fe) and production-related impurities.

In yet another aspect of the article, the ratio of the concentrations of cobalt to molybdenum (Co/Mo) in the alloy may have a value of from about 1.3 to about 1.9, for example, from about 1.5 to about 1.8.

In a still further aspect of the article, one or more of the following elements (e.g., at least 2, at least 3, at least 4 or all of the following elements) may be present in the alloy in the following concentrations (% by weight):

| | |
|---|---|
| Co | from about 24.0 to about 27.0 |
| Mo | from about 13.5 to about 17.5 |
| N | from about 0.008 to about 0.01 |
| Si | from about 0.2 to about 0.6 |
| Mn | from about 0.1 to about 0.3 |
| Cr | from about 0.03 to about 0.07 |
| V | from about 0.025 to about 0.06 |
| W | from about 0.03 to about 0.08 |
| Ni | from about 0.09 to about 0.2 |
| Ti | from about 0.003 to about 0.009 |
| (Nb and/or Ta) | from about 0.003 to about 0.009 |
| Al | from about 0.001 to about 0.009 |
| C | from about 0.01 to about 0.07 |
| P | not more than about 0.008 |
| S | not more than about 0.015. |

In another aspect of the article, the body part may have been made by using a powder metallurgical (PM) method and/or the body part may have been produced by a method which comprises a hot forming of an ingot (e.g., made by a PM method) which has been subjected to a hot isostatic pressing (HIP) with a degree of deformation of at least about 2.5-fold.

In another aspect of the method, the body part may have a hardness of higher than about 66 HRC, e.g., a hardness of higher than about 67 HRC.

In yet another aspect of the article, the nitrogen concentration in the alloy may increase toward the surface of the body part.

In another aspect of the article, the coating may have a thickness of at least about 0.8 μm and/or more than about 70% by volume (based on the total volume) of the coating, e.g., more than about 85% by volume, may be comprised of at least one layer (e.g., more than one layer) which has a substantially single-crystalline cubic face-centered structure. For example, the at least one layer may have a composition of general formula $(\Sigma Me_xAl_y)N$ wherein x has a value of from about 0.25 to about 0.50 (e.g., from about 0.28 to about 0.35), y has a value of from about 0.50 to about 0.75 (e.g., a value of from about 0.65 to about 0.72) and ΣMe comprises at least one element of Groups 4, 5 and 6 of the Periodic Table of Elements (such as, e.g., Ti and Cr). By way of non-limiting example, the at least one layer may have a composition of general formula $(Cr_xAl_y)N$ wherein x has a value of up to about 0.3 and y has a value of up to about 0.7, or may have a composition of general formula $(Ti_xAl_y)N$ wherein x has a value of up to about 0.33 and y has a value of up to about 0.67. Also, in another aspect, at least a part of the coating may comprise a metal oxide coating of substantially the composition $(Cr+Al)_2O_3$ and may comprise an alpha or kappa structure.

BRIEF DESCRIPTION OF THE DRAWINGS

The present invention is further described in the detailed description which follows, in reference to the noted plurality of drawings by way of non-limiting examples of exemplary embodiments of the present invention, in which drawings.

DETAILED DESCRIPTION OF THE PRESENT INVENTION

Figure 1:
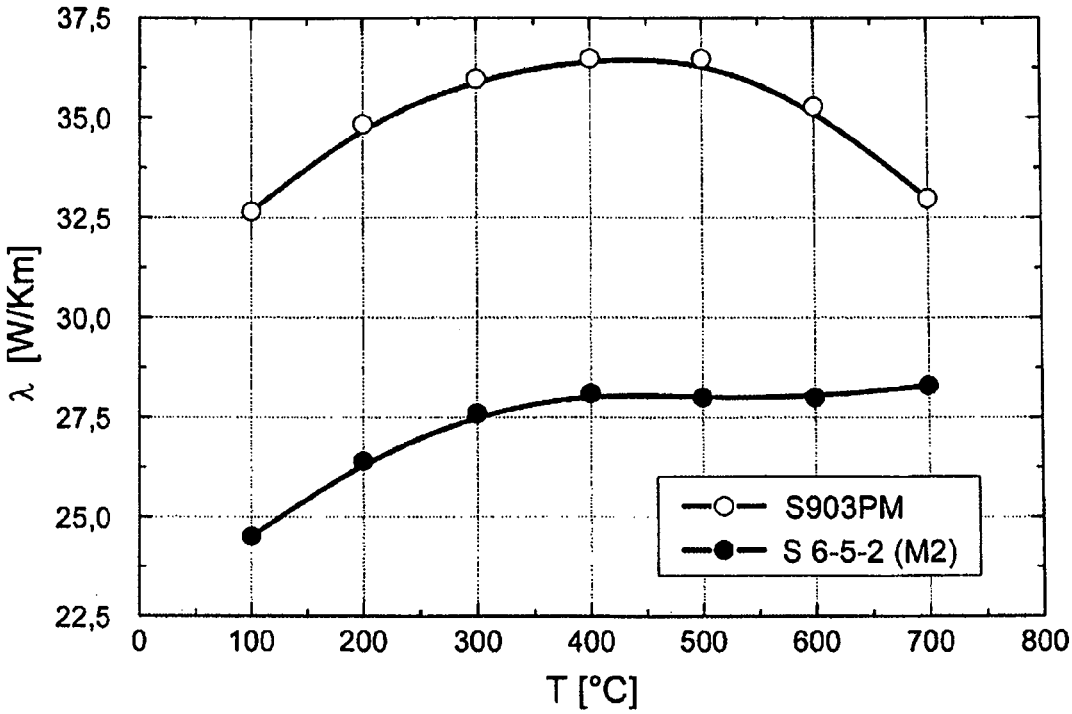
FIG. 1 is a graph which shows the thermal conductivity of a material according to the present invention and of a comparative material as a function of the temperature.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The advantages which may be associated with the present invention include an optimization in terms of alloying technology and the selected production type of the base body and the structure of the coating.

Through a nitrogen content of the Fe—Co—Mo/W—N alloy provided according to the invention, there is achieved not only a favorable precipitation behavior of the intermetallic phase with improved homogeneity, but the seeding conditions or the adhesion conditions for a hard material layer are also influenced advantageously.

An additional (and optional) PM production further improves the uniformity of a fine microstructure and has a favorable effect on the formability of the material.

The single-phase crystalline coating which is applied according to the invention onto the article or tool with improved adhesion also exhibits, in addition to a high hardness and a high toughness, a low surface roughness, which has particular advantages when cutting in particular tough metals, as has been shown, with respect to a reduced tool heating and an improved chip removal.

In other words: the advantages of the article or the like tool according to the invention are based in a synergy, as has been shown.

A microstructure with a fine distribution of the phases of the material is achieved by means of a powder-metallurgical production of the base body, which has a much higher thermal conductivity, wherein no perceptible material softening occurs at high temperatures, e.g., at about 600° C., compared to the highest alloyed high-speed steels. Another important factor is the alloying element nitrogen with a minimum concentration of about 0.005% by weight, in particular a minimum concentration of about 0.01% by weight in the substrate, because as a result thereof the adhesion of the growing coating is significantly stronger. Finally, a single-phase crystalline layer with cubic face-centered structure proves to be superior because it shows, on the one hand, improved mechanical properties and, on the other hand, provides a low surface roughness, which has advantages particularly in the case of cutting tools.

In total the working properties of the article are improved, in particular the edge-holding ability of a cutting tool is much extended.

Preferably the body part comprises an alloy comprising, in % by weight:

| | | |
|---|---|---|
| Cobalt | Co | from about 15.0 to about 30.0 |
| Molybdenum | Mo | up to about 20.0 |
| Tungsten | W | up to about 25.0 |
| Molybdenum + 0.5 Tungsten | Mo + W/2 | from about 10 to about 22.0 |
| Nitrogen | N | from about 0.005 to about 0.12 |

remainder iron (Fe) and production-related impurities.

It has been shown that the above-referenced alloy within wide limits of the chemical composition is also particularly suitable for an atomization of the liquid metal and the subsequent hardening to form largely homogeneous, small powder grains. Improved deformation conditions of the hot isostatically pressed (HIP) ingot also result thereby.

The producibility of a hot-formed article, but also the property profile of the base body of a tool and ultimately of the tool itself, can be further improved if the body part is produced by using a powder-metallurgical (PM) method for ingot production and from an alloy comprising, in % by weight:

| | |
|---|---|
| Cobalt (Co) | from about 20.0 to about 30.0 |
| Molybdenum (Mo) | from about 11.0 to about 19.0 |
| Nitrogen (N) | from about 0.005 to about 0.12 |
| Silicon (Si) | from about 0.1 to about 0.8 |
| Manganese (Mn) | from about 0.1 to about 0.6 |
| Chromium (Cr) | from about 0.02 to about 0.2 |
| Vanadium (V) | from about 0.02 to about 0.2 |
| Tungsten (W) | from about 0.01 to about 0.9 |
| Nickel (Ni) | from about 0.01 to about 0.5 |
| Titanium (Ti) | from about 0.001 to about 0.2 |
| Niobium/Tantalum (Nb/Ta) | from about 0.001 to about 0.1 |
| Aluminum (Al) | not more than about 0.043 |
| Carbon (C) | not more than about 0.09 |
| Phosphorus (P) | not more than about 0.01 |
| Sulfur (S) | not more than about 0.02 |
| Oxygen (O) | not more than about 0.032 |

remainder iron (Fe) and production-related impurities, with the proviso that the ratio of the concentrations of cobalt to molybdenum (Co/Mo) has a value of from about 1.3 to about 1.9 and that the surface of the tool or article carries a coating with a thickness of at least about 0.8 μm.

An optimization in terms of alloying technology of the chemical composition pursuant to the above values relates to the concentration of the base elements, the ratio of cobalt to molybdenum, a limitation of the microalloy elements and a limitation of the impurities in the material. The nitrogen content is ambivalent, on the one hand, with respect to the microstructure, on the other hand, advantageously effective with respect to an adhesion and the type of coating.

The results of extensive testing show that the use of mainly molybdenum as a base element with small tungsten values has advantages in the formation of the phase $(FeCo)_7Mo_6$ and subsequently in the hardening behavior, wherein a cobalt to molybdenum ratio within narrow limits is favorable for imparting hardness in the thermal treatment.

Of the microalloy elements in the stated ranges that are advantageously effective for the production and for the property profile of the material, the elements silicon and manganese stand out, which in particular may reduce harmful grain boundary deposits.

The impurity elements aluminum and carbon are ambivalently effective, but should not exceed the given maximum values of the concentrations. Phosphorus, sulfur and oxygen, however, should be considered harmful substances whose concentrations in the alloy should be as low as possible.

Another improvement in the material characteristic values can be achieved if one or more alloy constituent(s) or accompanying element(s) has (have) the following concentrations, in % by weight:

| | |
|---|---|
| Co | from about 24.0 to about 27.0 |
| Mo | from about 13.5 to about 17.5 |
| N | from about 0.008 to about 0.01 |
| Si | from about 0.2 to about 0.6 |
| Mn | from about 0.1 to about 0.3 |
| Cr | from about 0.03 to about 0.07 |
| V | from about 0.025 to about 0.06 |
| W | from about 0.03 to about 0.08 |
| Ni | from about 0.09 to about 0.2 |
| Ti | from about 0.003 to about 0.009 |
| Nb/Ta | from about 0.003 to about 0.009 |
| Al | from about 0.001 to about 0.009 |

-continued

| | |
|---|---|
| C | from about 0.01 to about 0.07 |
| P | not more than about 0.008 |
| S | not more than about 0.015. |

An additional advantage can be achieved if the ratio of the concentrations of Co to Mo in the alloy (Co/Mo) has a value of about 1.5 to about 1.8.

If the hardness of the body part exceeds a value of about 66 HRC, in particular of about 67 HRC, as can be provided according to the invention for the tool or the article, the highest possible stability of the coating can be achieved. Also a high hardness of the body part or of the base body prevents breaking of the brittle hard material layer under small-area pressure loading, that is, a locally high specific area loading. An improved support of the coating on the substrate with high hardness causes the hard layer to remain intact, prevents a partial flaking off of the same and thus extends the service life of the tool.

If, according to one embodiment of the invention, the body part of the tool or of the article is produced from one of the aforementioned alloys with a hot working of the hot isostatically pressed (HIP) ingot at a degree of deformation of at least about 2.5 fold, the material toughness can be increased despite a high material hardness.

The tool or the like article according to the invention mentioned at the outset has a coating with a largely single-phase crystalline structure. A largely single-phase cubic face-centered atomic structure of the applied layer can only be achieved at a coating temperature of substantially above about 500° C.

It was found in scientific tests that the energy potential consisting of thermodynamic and kinetic energy in the micro range during the layer formation or growing of the layer structure has a decisive influence on the formation of the microstructure of the growing layer. A high energy promotes the diffusion of the atoms with a columnar layer formation and thus causes a compact coherent cubic face-centered electrically conducting, substantially single-phase layer structure with high layer hardness. Although a hexagonal atomic structure of the layer is hard, it is also brittle and not electrically conductive.

If a high energy or thermal stress in the micro range is achieved according to the invention on the substrate with an above-mentioned chemical composition during the layer formation without a reduction in the material hardness, hard, smooth and tough surface coatings can be produced, which also have a low tendency to break with local stress due to the high substrate hardness and thus provide a high quality of the tool or article.

To largely avoid any amorphous and/or hexagonal parts in the layers applied, for a single-phase crystalline structure of the same a temperature of about 520° C. to about 600° C. is usually used in the PVD (physical vapor deposition) or CVD (chemical vapor deposition) process. However, such high coating temperatures can have a retroactive effect on the material hardness of a base body or body part made of customary tool steels such as, e.g., high-speed steels.

The invention is explained in more detail by way of example based on data and results from tests.

An experimental melt with concentrations in % by weight of the base elements:

| | |
|---|---|
| Cobalt | 25 |
| Molybdenum | 15 |
| Tungsten | 0.1 |
| Nitrogen | 0.02 |

the microalloy elements:

| | |
|---|---|
| Silicon | 0.29 |
| Manganese | 0.21 |
| Chromium | 0.05 |
| Vanadium | 0.03 |
| Nickel | 0.1 |
| Titanium | 0.004 |
| Niobium/tantalum | 0.004 |

the impurity elements:

| | |
|---|---|
| Aluminum | 0.002 |
| Carbon | 0.028 |
| Phosphorus | 0.002 |
| Sulfur | 0.0021 |

the remainder being iron was atomized with gas, the metal powder formed therefrom placed in a capsule with a diameter of 423 mm Ø, sealed therein in a pressure-tight manner, and this capsule was subjected to hot isostatic pressing (HIP).

The HIP ingot with a diameter of about 400 mm Ø thus produced was subjected to hot rolling at high temperature to afford a round bar with a diameter of 31 mm Ø.

Samples were made from the round bar, which were used in materials engineering tests.

Furthermore, this round material was used for the production of a circumferential milling cutter for constant-stress tests of the tool.

In order carry out a comparison of the alloy according to the invention, which was given the designation S 903 PM in the test reports, or of the tools made therefrom with cutting materials of other types, high-speed steels of the type S 6-5-2 (M2) and a super high-speed steel tool of the brand S-ISO-PM were drawn out of production.

The chemical compositions in % by weight of the comparative materials are given below:

S 6-5-2 (M2): C=0.91, Cr=4.15, Mo=5.1, V=1.82, W=6.39, Fe and impurities=remainder.

S-ISO-PM: C=1.612, Cr=4.79, Mo=2.11, V=5.12, W=10.49, Co=8.12, Fe and impurities=remainder.

The test results for the alloy or coating or tools according to the present invention can be seen from the diagrams of FIGS. 1 through 5, in some cases compared to the cited high-speed steels.

Figure 2:
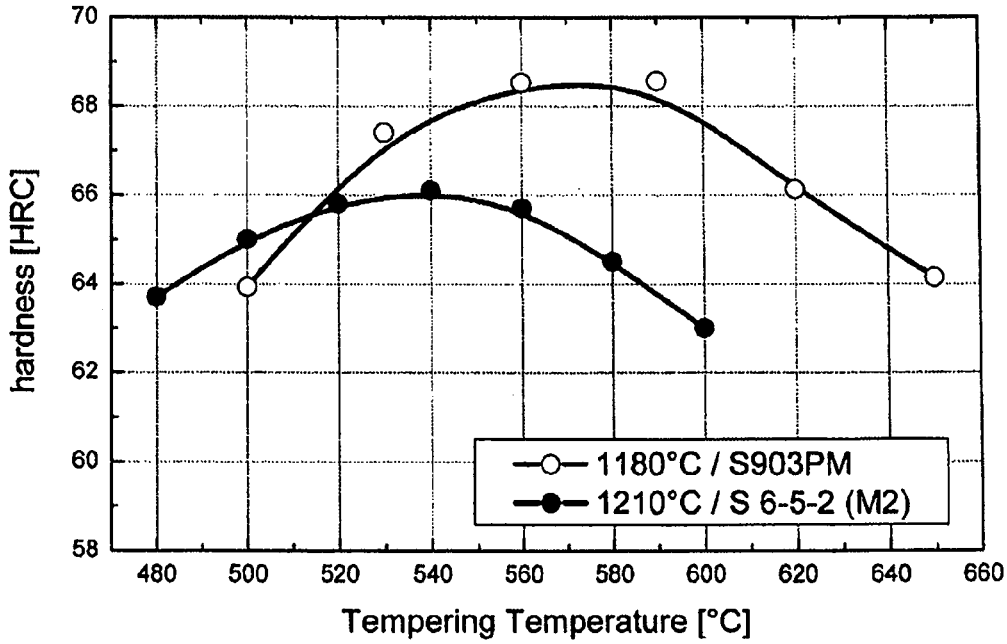
FIG. 2 is a graph which shows the hardness of a material according to the present invention and of a comparative material as a function of the temperature.
Figure 3:
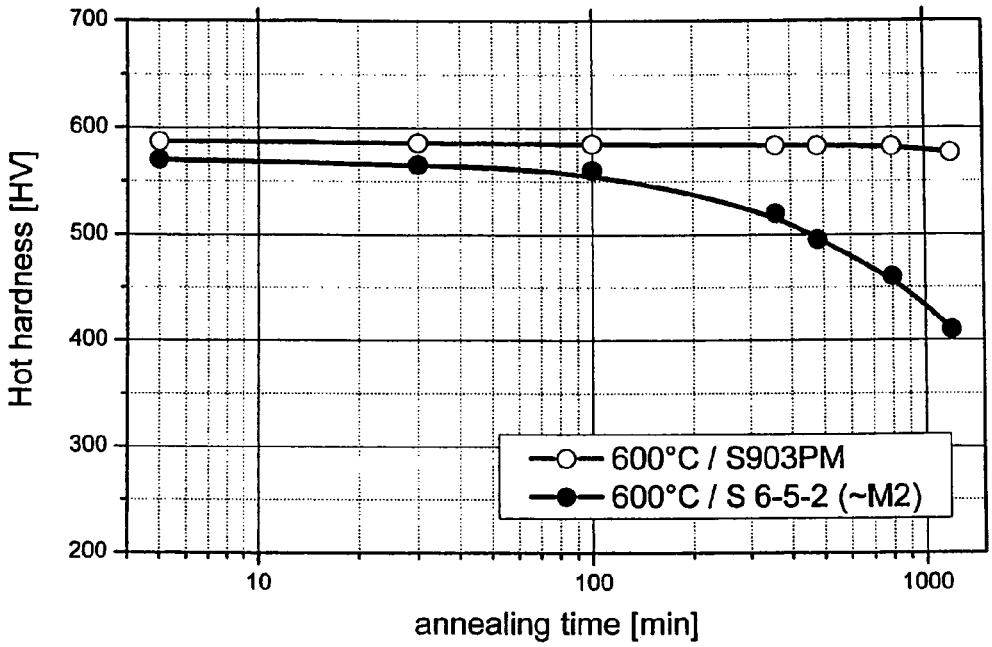
FIG. 3 is a graph which shows the hot hardness of a material according to the present invention and of a comparative material as a function of time.
Figure 4:
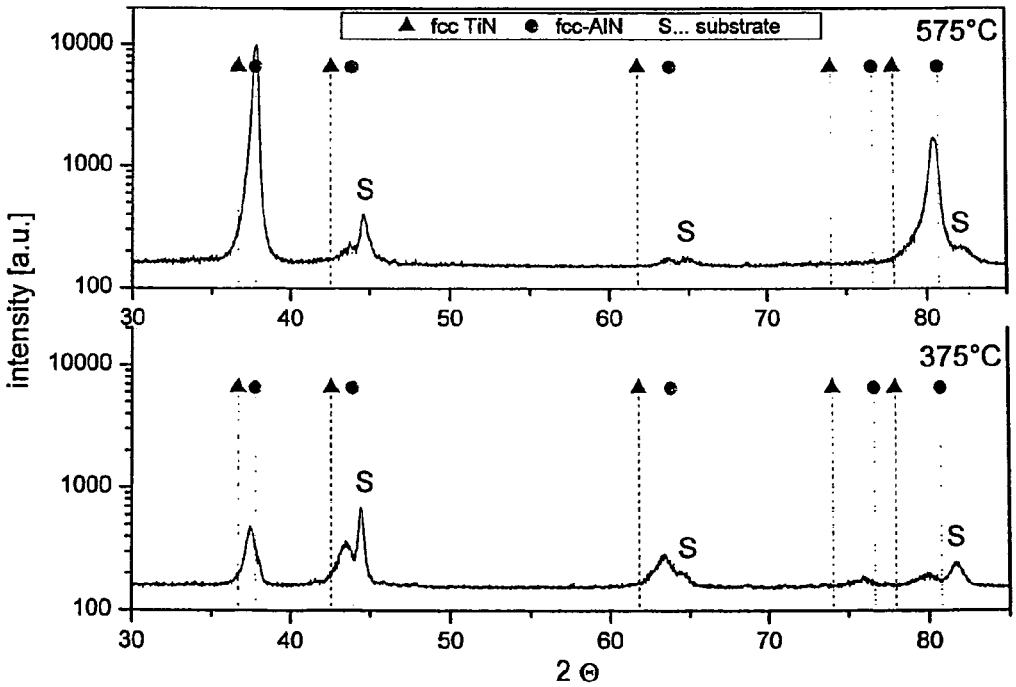
FIG. 4 shows the results of x-ray examinations of a coating according to the present invention.
Figure 5:
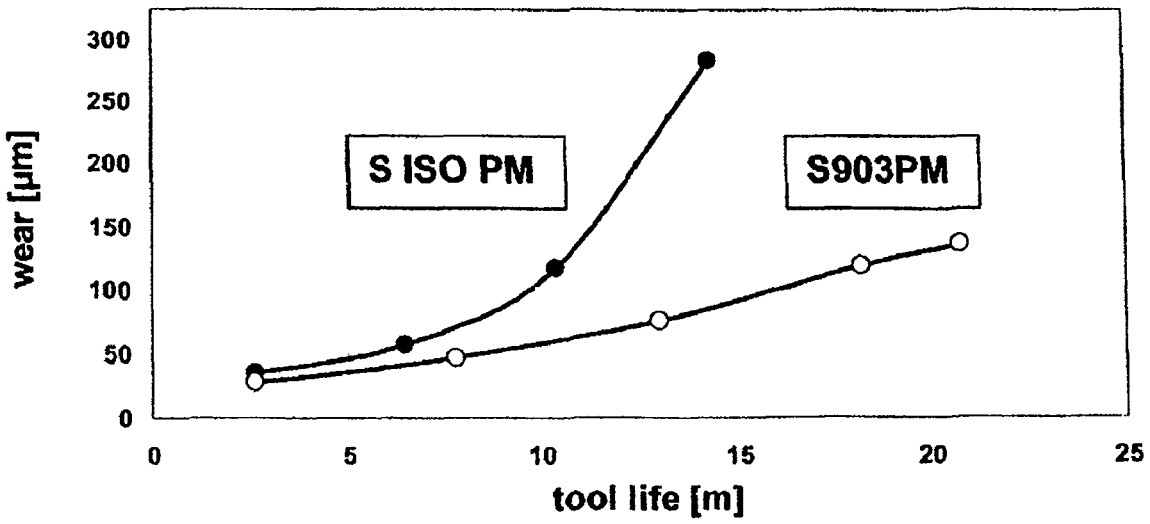
FIG. 5 is a graph showing the wear of a cutting tool according to the present invention and a comparative cutting tool as a function of time in use.

They show:

FIG. 1 Thermal conductivity of the material as a function of temperature;

FIG. 2 Material hardness as a function of tempering temperature;

FIG. 3 Hot hardness of the material as a function of time;

FIG. 4 Results of x-ray examinations of the coating;

FIG. 5 Tool wear as a function of time in use.

FIG. 1 shows that a Fe—Co—Mo—N alloy, which in the present case is the material S 903 PM, in particular in the range between RT and 600° C. has a much higher thermal conductivity than a high-speed steel of the type S 6-5-2 (M2). During cutting with a tool according to the invention this leads to increased heat dissipation from the cutting area into the tool body, through which an increased stability of the material and a reduced wear of the cutting edges can be achieved.

With a heat treatment of the Fe—Co—Mo—N alloy (S 903 PM) according to the invention, as shown in FIG. 2, first a solution annealing mostly in a vacuum is carried out at a temperature in the range of 1160° C. to 1200° C., in particular at about 1180° C., followed by a quenching preferably with nitrogen at negative pressure. A subsequent tempering of the solution-annealed material leads to a precipitation of substantially $(FeCo)_7Mo_6$ phases, through which an increase of the material hardness of up to above 68 HRC occurs up to a tempering temperature of about 590° C. A high material hardness of about 66 HRC can still be achieved at a tempering temperature of 620° C.

As shown in FIG. 2, compared to a high-speed steel S 6-5-2 (M2) which was quenched from 1210° C., an Fe—Co—Mo—N material yields much higher hardness values at high tempering temperatures, due to which applied coatings, in particular with single-phase crystalline structure, do not show any tendency to break at high local action of force.

If, as shown in FIG. 3, the hot hardness at 600° C. of the Fe—Co—Mo—N material (S 903 PM) is compared to that of a high-speed steel S 6-5-2 (M2) as a function of the annealing time, no decrease in the hardness values of the base body of a tool according to the invention occurs for up to 1000 min., in contrast to the high speed steel.

The hardness and modulus of elasticity of a layer deposited on a substrate according to the PVD or CVD process increases with higher coating temperatures. At the same time the roughness of the surface of the applied layer, in particular of a single-phase crystalline structure, is reduced.

It was expected by those skilled in the art or according to expert opinion, that a PVD or CVD layer having a single-phase crystalline structure would have a poor adhesion to the substrate. However, tests of nitrogen-alloyed and precipitation hardened Fe—Co—Mo—N articles have now shown that a crystalline layer which has been applied at high temperatures has a much higher security against detachment from the base body. A strictly scientific explanation for this is not yet available, but it can be assumed that the concentrations of nitrogen in the substrate promote a seeding of a $(\Sigma Me_xAl_y)N$ layer with the above structure.

An increased nitrogen concentration on the surface of the tool body part can also be achieved by adding nitrogen thereto to a nitrogen content of up to about 0.4% by weight. As stated above, favorable kinetics for a growth of the layer on the substrate can be achieved in this manner.

The structure of a PVC or CVD layer which has been applied on a substrate or a tool can be determined through x-ray tests. High-temperature layers having a single-phase crystalline cubic face-centered structure show a much higher degree of reflection in the angle range of the compound TiN/AIN with the same x-ray beam intensity due to the lattice planes of the crystals, as shown in FIG. 4.

The test results of layers according to FIG. 4 show that, compared to low-temperature layers that were applied at a temperature of up to 375° C. (lower partial image), high-temperature layers applied at 575° C. have an at least 5-fold, preferably an at least 10-fold intensity, measured in pulses through TiN/AIN at 2 theta (2Θ) between 60 and 80.

As mentioned, a milling cutter with grinding allowance was cut from the round material according to the production described above and subjected to a heat treatment in a vacuum at a solution annealing temperature of 1180° C. with a subsequent quenching in nitrogen at 5 bar. Subsequently a hardening of the raw milling cutter was carried out at a temperature between 580° C. and 620° C. for a period between about 2 and 4 hours.

After a grinding to tool dimensions, a coating was carried out at about 595° C. according to the PVD process, which resulted in the deposition of a single-phase crystalline layer of $(Ti_xAl_y)N$ with a thickness of about 5 μm and values of x=0.33 and y=0.67.

The same type of milling cutter was produced from a super high-speed steel of the brand S-ISO-PM with an above-mentioned composition, heat treated and coated with hard material.

The tests for determining the service life of both tools in practical operation were carried out by cutting samples from a TiAl6V4 alloy with the following parameters:

| | |
|---|---|
| Cutting speed: | Vc = 80 m/min |
| Feed: | f = 0.1 mm/tooth |
| Cutting depth axial: | ap = 5.0 mm |
| Cutting width radial: | ae = 0.5 mm |

As shown in FIG. 5, the service life of the tool according to the invention was significantly longer, or the cutting wear was extremely low. The possible service life of a tool according to the invention can be extended considerably in this manner.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A coated metal article, wherein the article comprises a body part comprising a substantially carbon-free precipitation-hardened alloy which comprises iron, cobalt, at least one of molybdenum and tungsten, and at least 0.005% by weight of nitrogen and wherein the article carries a coating which has been applied by at least one of a PVD method and a CVD method and comprises a substantially single-phase crystalline, cubic face-centered structure.

2. The article of claim 1, wherein the article is a tool.

3. The article of claim 2, wherein the tool is suitable for cutting metals.

4. The article of claim 1, wherein the body part comprises an alloy which comprises, in % by weight:

| | |
|---|---|
| Co | from about 15.0 to about 30.0 |
| Mo | up to about 20.0 |

-continued

| | |
|---|---|
| W | up to about 25.0 |
| (Mo + W/2) | from about 10.0 to about 22.0 |
| N | from 0.005 to about 0.12 |

remainder iron (Fe) and production-related impurities.

5. The article of claim 4, wherein the alloy comprises, in % by weight:

| | |
|---|---|
| Co | from about 20.0 to about 30.0 |
| Mo | from about 11.0 to about 19.0 |
| N | from 0.005 to about 0.12 |
| Si | from about 0.1 to about 0.8 |
| Mn | from about 0.1 to about 0.6 |
| Cr | from about 0.02 to about 0.2 |
| V | from about 0.02 to about 0.2 |
| W | from about 0.01 to about 0.9 |
| Ni | from about 0.01 to about 0.5 |
| Ti | from about 0.001 to about 0.2 |
| (Nb and/or Ta) | from about 0.001 to about 0.1 |
| Al | from 0 to about 0.043 |
| C | from 0 to about 0.09 |
| P | from 0 to not more than about 0.01 |
| S | from 0 to not more than about 0.02 |
| O | from 0 to not more than about 0.032 |

remainder iron (Fe) and production-related impurities.

6. The article of claim 5, wherein a ratio of concentrations of cobalt to molybdenum (Co/Mo) has a value of from about 1.3 to about 1.9.

7. The article of claim 6, wherein the ratio has a value of from about 1.5 to about 1.8.

8. The article of claim 5, wherein one or more of the following elements are present in the alloy in the following concentrations (% by weight):

| | |
|---|---|
| Co | from about 24.0 to about 27.0 |
| Mo | from about 13.5 to about 17.5 |
| N | from about 0.008 to about 0.01 |
| Si | from about 0.2 to about 0.6 |
| Mn | from about 0.1 to about 0.3 |
| Cr | from about 0.03 to about 0.07 |
| V | from about 0.025 to about 0.06 |
| W | from about 0.03 to about 0.08 |
| Ni | from about 0.09 to about 0.2 |
| Ti | from about 0.003 to about 0.009 |
| (Nb and/or Ta) | from about 0.003 to about 0.009 |
| Al | from about 0.001 to about 0.009 |
| C | from about 0.01 to about 0.07 |
| P | not more than about 0.008 |
| S | not more than about 0.015. |

9. The article of claim 1, wherein the body part has been made by using a powder metallurgical method.

10. The article of claim 9, wherein the body part has been produced by a method which comprises a hot forming of an ingot which has been subjected to hot isostatic pressing (HIP) with a degree of deformation of at least about 2.5-fold.

11. The article of claim 1, wherein the body part has a hardness of higher than about 66 HRC.

12. The article of claim 11, wherein the hardness is higher than about 67 HRC.

13. The article of claim 1, wherein a nitrogen concentration in the alloy increases toward a surface of the body part.

14. The article of claim 1, wherein the coating has a thickness of at least about 0.8 μm.

15. The article of claim 1, wherein more than about 70% by volume of the coating are comprised of at least one layer having a substantially single-crystalline cubic face-centered structure.

16. The article of claim 15, wherein the coating is comprised of more than one layer having a substantially single-crystalline cubic face-centered structure.

17. The article of claim 15, wherein more than about 85% by volume of the coating are comprised of the at least one layer.

18. The article of claim 15, wherein the at least one layer has a composition of general formula $(\Sigma Me_xAl_y)N$ wherein x has a value of from about 0.25 to about 0.50, y has a value of from about 0.50 to about 0.75 and ΣMe comprises at least one element of Groups 4, 5 and 6 of the Periodic Table of Elements.

19. The article of claim 18, wherein x has a value of from about 0.28 to about 0.35 and y has a value of from about 0.65 to about 0.72.

20. The article of claim 18, wherein the at least one layer has a composition of general formula $(Cr_xAl_y)N$ wherein x has a value of up to about 0.3 and y has a value of up to about 0.7.

21. The article of claim 18, wherein the at least one layer has a composition of general formula $(Ti_xAl_y)N$ wherein x has a value of up to about 0.33 and y has a value of up to about 0.67.

22. The article of claim 15, wherein at least a part of the coating comprises a metal oxide coating of substantially the composition $(Cr+Al)_2O_3$ and comprises an alpha or kappa structure.

* * * * *